US006864845B2

(12) United States Patent
Kuo et al.

(10) Patent No.: US 6,864,845 B2
(45) Date of Patent: Mar. 8, 2005

(54) MULTI-BAND ANTENNA

(75) Inventors: Chia-Ming Kuo, Tu-Chen (TW); Lung-Sheng Tai, Tu-Chen (TW); Kuang-Yuan Chang, Tu-Chen (TW); Zhen-Da Hung, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/447,133

(22) Filed: May 27, 2003

(65) Prior Publication Data

US 2004/0174305 A1 Sep. 9, 2004

(30) Foreign Application Priority Data

Mar. 7, 2003 (TW) ..... 92203519 U

(51) Int. Cl.[7] ..... H01Q 1/24
(52) U.S. Cl. ..... 343/702; 343/846
(58) Field of Search ..... 343/700 MS, 702, 343/846, 848, 850

(56) References Cited

U.S. PATENT DOCUMENTS

| | | | | |
|---|---|---|---|---|
| 5,148,181 | A | 9/1992 | Yokoyama et al. | 343/702 |
| 5,764,190 | A | 6/1998 | Murch et al. | 343/702 |
| 6,222,496 | B1 | 4/2001 | Liu | 343/846 |
| 6,297,776 | B1 | 10/2001 | Pankinaho | 343/700 MS |
| 6,342,860 | B1 | 1/2002 | Haussler et al. | 343/702 |
| 2004/0104849 | A1 * | 6/2004 | Tai et al. | 343/700 MS |

* cited by examiner

*Primary Examiner*—Hoang V. Nguyen
(74) *Attorney, Agent, or Firm*—Wei Te Chung

(57) ABSTRACT

A multi-band antenna (1) includes a grounding portion (10), a first radiating arm (21), a second radiating arm (22), a connection portion (23) and a feed line (40) being soldered to the connection portion. The connection portion includes an end connecting with the grounding portion and an opposite end connecting with the first and the second radiating arms. The feed line is soldered to a selected section of the connection portion. The selected section is arranged between two ends of the connection portion. By changing the solder point of the feed line on the connection portion, the characteristics of the multi-band antenna can be conveniently and precisely adjusted.

19 Claims, 9 Drawing Sheets

Scale: 5dBi/div
Operating Frequency: 2.5GHz
Horizontally polarized

Scale: 5dBi/div
Operating Frequency: 2.5GHz
Vertically polarized

Scale: 5dBi/div
Operating Frequency: 5.35GHz
Horizontally polarized

Scale: 5dBi/div
Operating Frequency: 5.35GHz
Vertically polarized

Scale: 5dBi/div
Operating Frequency: 5.725GHz
Horizontally polarized

Scale: 5dBi/div
Operating Frequency: 5.725GHz
Vertically polarized

MULTI-BAND ANTENNA

CROSS-REFERENCE TO RELATED APPLICATION

This application is related to a co-pending U.S. patent application entitled "DUAL BAND ANTENNA", with application Ser. No. 10/330,959, filed on Dec. 26, 2002, invented by Lung-Sheng Tai, Hsien-Chu Lin, Chia-Ming Kuo and Zhen-Da Hung, and assigned to the same assignee of the present invention.

BACKGROUND OF THE INVENTION

1. Field of the Invention

The present invention relates to an antenna, and in particular to an antenna which is capable of operating in multiple frequency bands.

2. Description of the Prior Art

In recent years, most wireless local area networks (WLANs) use for both 802.11a and 802.11b. The 802.11b standard runs in the 2.4 GHz frequency band. The wireless 802.11a standard runs in the 5 GHz spectrum, from 5.15 to 5.825 GHz, comprising 5.15–5.35 GHz, 5.47–5.725 GHz and 5.725–5.825 GHz frequency bands. Thus, antennas, which can operate in both 2.4 GHz and 5 GHz, become increasingly popular.

U.S. Pat. No. 6,166,694, issued to Ying on Dec. 26, 2000, discloses a conventional antenna. The conventional antenna comprises a first spiral arm and a second spiral arm which are carried by a dielectric substrate. The first spiral arm is sized to function as a first planar inverted-F antenna (PIFA) operating in a first frequency band. The second spiral arm is sized to function as a second PIFA operating in a second frequency band. The conventional antenna forms a matching bridge which is positioned between a feeding pin and a grounding post. By adjusted the length of the matching bridge, the matching of the conventional antenna can be changed. Changing the location of the grounding post can adjust the length of the matching bridge. However, because the grounding post is immovable, changing the location of the grounding post is inconvenient. Therefore, the matching of the antenna cannot be conveniently changed.

U.S. Pat. No. 6,297,776 discloses a conventional PIFA. The conventional PIFA comprises a radiator having a free end fold towards a ground portion. The folded free end of the radiator is capacitively coupled to the ground portion, thereby controlling the characteristics of the PIFA. However, the conventional PIFA operates only in a single frequency band, which cannot comply with dual-band or multi-band operating requirement.

Hence, an improved antenna is desired to overcome the above-mentioned shortcomings of existing antennas.

BRIEF SUMMARY OF THE INVENTION

A main object of the present invention is to provide a low-cost multi-band antenna which allows adjusting the performance of the antenna conveniently.

A multi-band antenna in accordance with the present invention is mounted in an electronic device for transmitting or receiving signals. The multi-band antenna comprises a grounding portion, a first radiating portion operating in a first frequency band, a second radiating portion operating in a second frequency band, a connection portion and a feed line being soldered to the connection portion. The connection portion is provided for interconnecting the grounding portion and the first and the second radiating portions. The connection portion comprises an end connecting with the grounding portion and an opposite end connecting with the first and the second radiating portions. The feed line is soldered to a selected section of the connection portion. The selected section is arranged between two ends of the connection portion. By changing the solder point of the feed line on the connection portion, the characteristics of the multi-band antenna can be conveniently and precisely adjusted.

Other objects, advantages and novel features of the invention will become more apparent from the following detailed description of a preferred embodiment when taken in conjunction with the accompanying drawings.

DETAILED DESCRIPTION OF THE INVENTION

Reference will now be made in detail to a preferred embodiment of the present invention.

Figure 1:
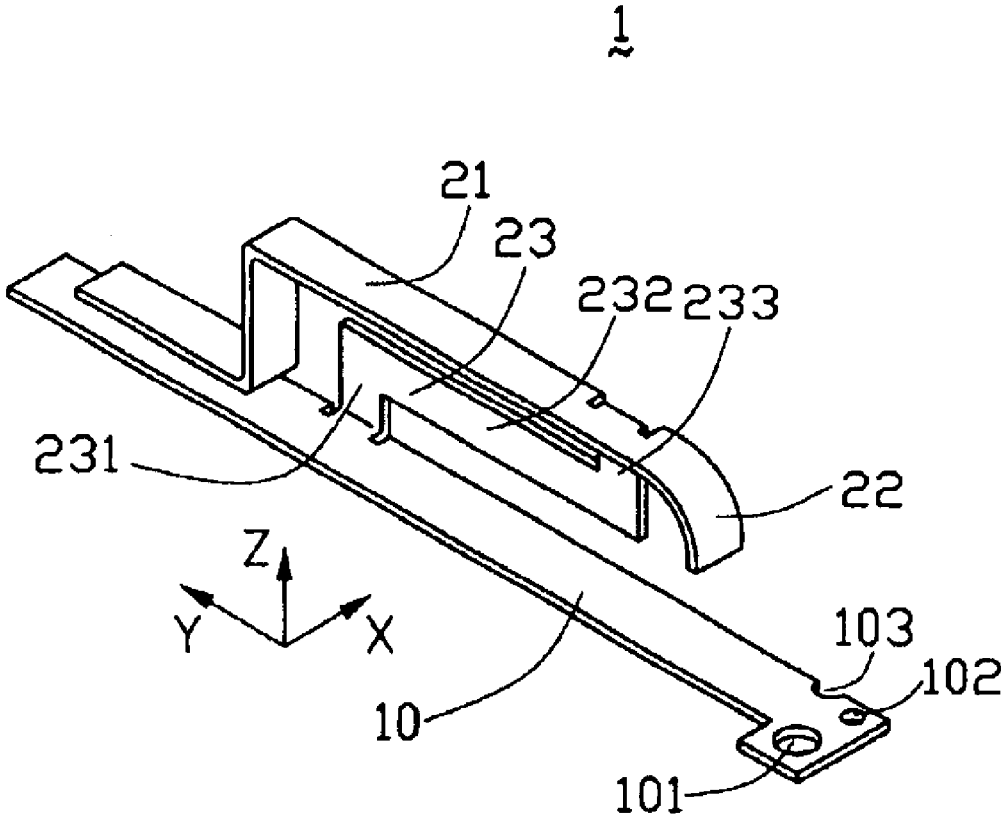
FIG. 1 is a perspective view of a multi-band antenna in accordance with the present invention.
Figure 2:
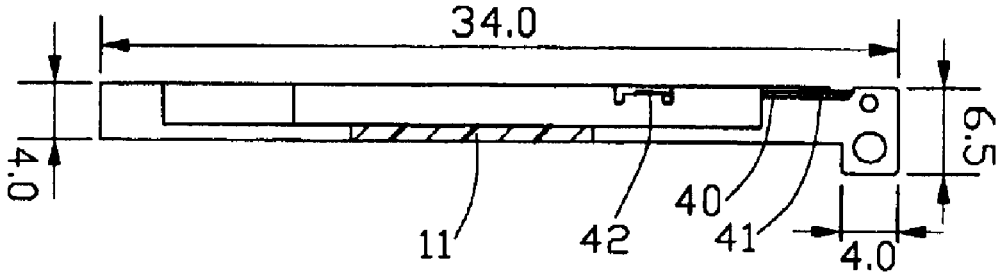
FIG. 2 is a top view of the multi-band antenna of FIG. 1 with a feed line connected therewith, showing detailed dimensions thereof.
Figure 3:
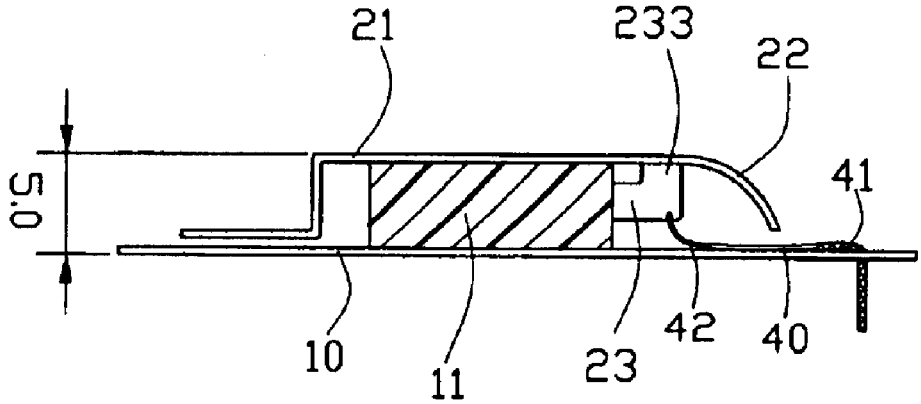
FIG. 3 is a front view of FIG. 2.

Referring to FIGS. 1–3, a multi-band antenna 1 in accordance with a preferred embodiment of the present invention is mounted in an electrical device (not shown), such as laptop computer, desktop computer or mobile phone, for transmitting or receiving signals. The multi-band antenna 1 can be formed of conductive material, such as a metal foil, and comprises a grounding portion 10, a first radiating arm 21 and a second radiating arm 22 spaced from the grounding portion 10, a connection portion 23 and a feed line 40.

The grounding portion 10 is an elongate planar strip horizontally extending, and defines two circular mounting holes 101, 102 in an end for mounting the multi-band antenna 1 in an electrical device (not shown). The mounting holes 101, 102 are arranged in a front-to-rear direction. Adjacent to the holes 102, a semi-circular fixing notch 103 is defined through a rear edge of the grounding portion 10 for securing the feed line 40.

The first radiating arm 21 is a horizontal elongate strip and is parallelly isolated from the grounding portion 10. A free end of the first radiating arm 21 is bent downwardly and then extends horizontally to form a step-like configuration, thereby shortening the whole length of the multi-band antenna 1. The second radiating arm 22 extends from the other end of the first radiating arm 21 towards the grounding portion 10 to form a circular curved section (not labeled) on a free end thereof. The curved section has a concave surface facing the grounding portion 10.

The connection portion 23 has a step-like configuration and is provided for interconnecting the grounding portion 10 and the first and the second radiating arms 21, 22, wherein a first segment 231 thereof vertically extends from the rear edge of the grounding portion 10, a third segment 233 thereof vertically connects with the joint of the first and the second radiating arms 21, 22, and a second segment 232 horizontally interconnecting the first segment 231 with the third segment 233. The second segment 232 is positioned between the radiating arms 21, 22 and the grounding portion 10, thereby being capacitively coupled to the radiating arms 21, 22 and the grounding portion 10. The second segment 232 has a predetermined length, whereby the characteristics of the multi-band antenna 1 can be approximately adjusted.

In this preferred embodiment, the feed line 40 is a coaxial cable retained by the fixing notch 103 of the grounding portion 10. The feed line 40 comprises an outer conductor 41 and an inner conductor 42. The inner conductor 42 is soldered to a selective point of a rear surface of the second segment 232 for transmitting signals between the multi-band antenna 1 and a signal unit of an electrical device (not shown). The solder point of the inner conductor 42 on the second segment 232 is properly selected, thereby the characteristics of the multi-band antenna 1 can be precisely adjusted. In the preferred embodiment, the inner conductor 42 is soldered to the joint of the second and the third segments 232, 233 of the connection portion 23. The outer conductor 41 is soldered on the grounding portion 10 for grounding the multi-band antenna 1.

Detailed dimensions of the multi-band antenna 1 are shown in FIGS. 2 and 3. The dimensions are in millimeters and are such that the multi-band antenna 1 is configured to resonate within the two frequency bands. The first radiating arm 21, the connection portion 23, the grounding portion 10 and the feed line 40 are configured and sized to function as a first planar inverted-F antenna (PIFA), resonating in a lower frequency band between 2.38 GHz and 2.58 GHz (i.e., the 2.45 GHz frequency band). The second radiating arm 22, the connection portion 23, the grounding portion 10 and the feed line 40 are configured and sized to function as a second PIFA, resonating in a higher frequency band between 4.8 GHz and 6 GHz (i.e., the 5 GHz frequency band). The first and the second PIFAs constitute nearly independent regions having different resonant frequencies.

Figure 4:
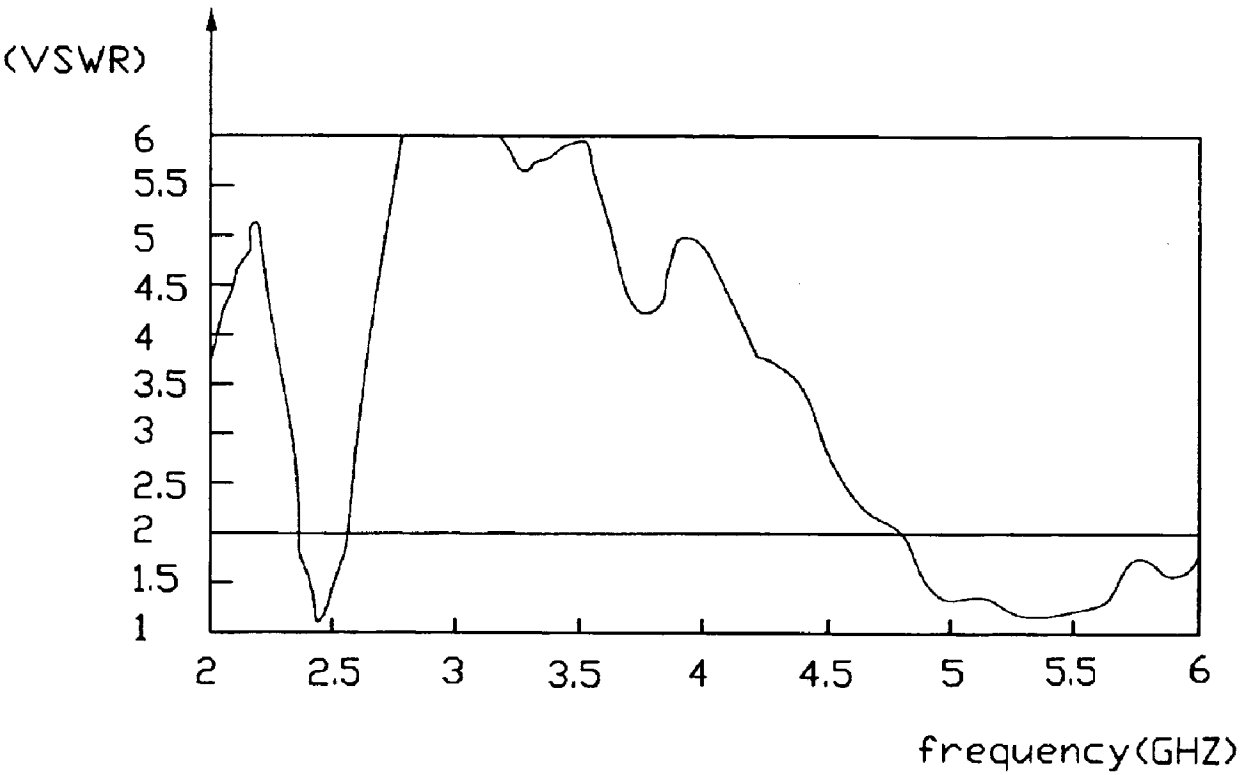
FIG. 4 is a test chart recording for the multi-band antenna of FIG. 1, showing Voltage Standing Wave Ratio (VSWR) as a function of frequency.
Figure 5:
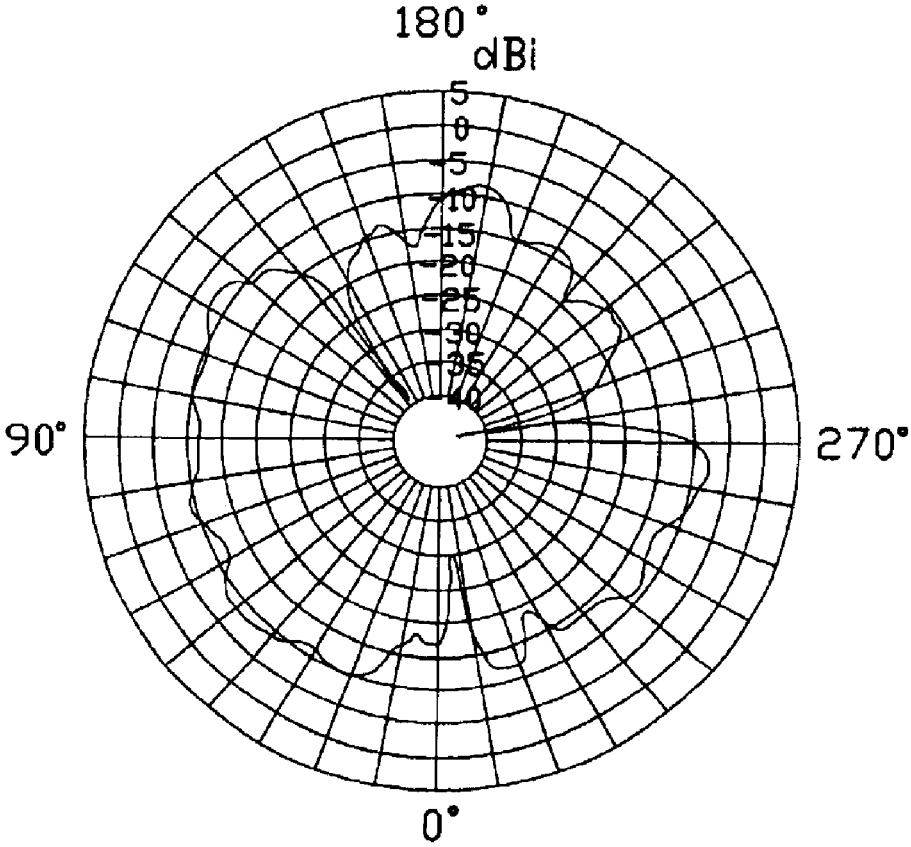
FIG. 5 is a horizontally polarized principle plane radiation pattern (where the principle plane is an X-Y plane) of the multi-band antenna of FIG. 1 operating at a frequency of 2.5 GHz.
Figure 6:
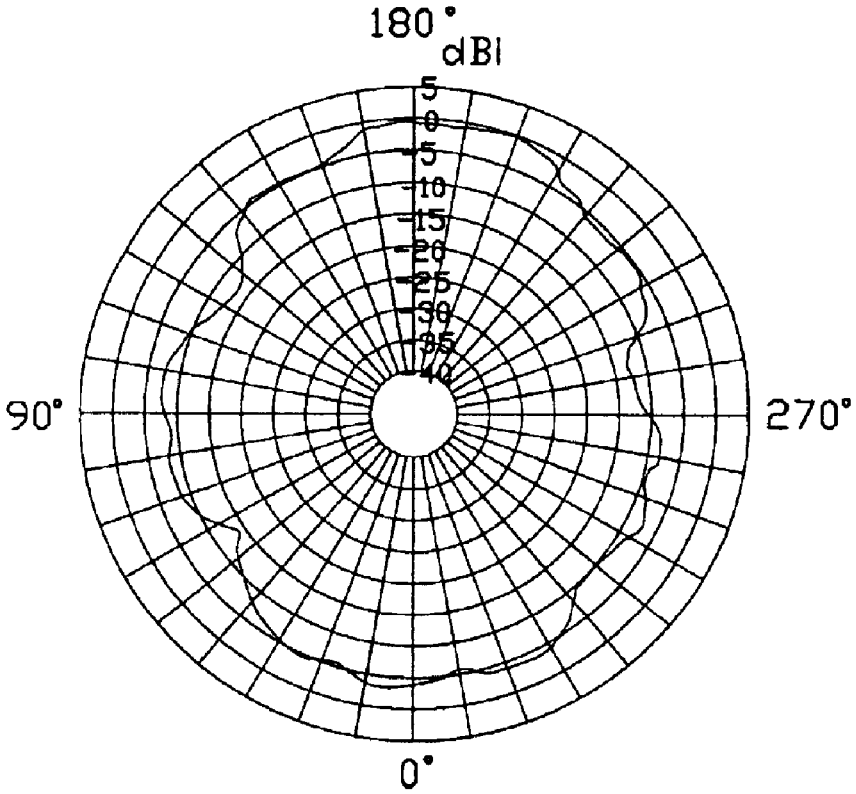
FIG. 6 is a vertically polarized principle plane radiation pattern (where the principle plane is an X-Y plane) of the multi-band antenna of FIG. 1 operating at a frequency of 2.5 GHz.
Figure 7:
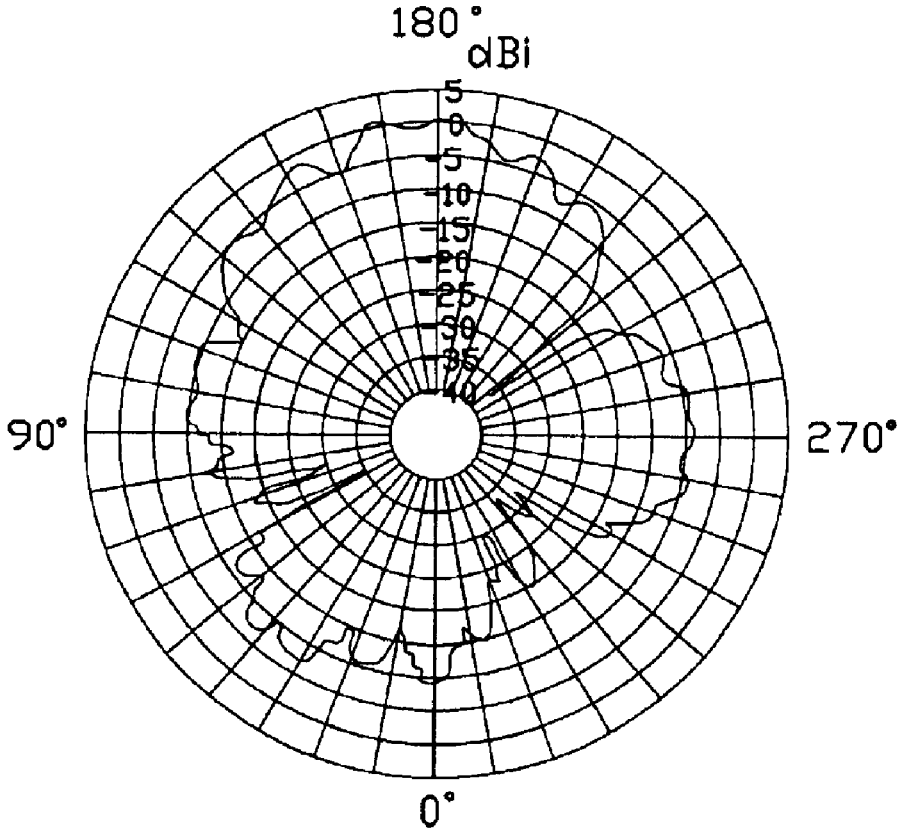
FIG. 7 is a horizontally polarized principle plane radiation pattern (where the principle plane is an X-Y plane) of the multi-band antenna of FIG. 1 operating at a frequency of 5.35 GHz.
Figure 8:
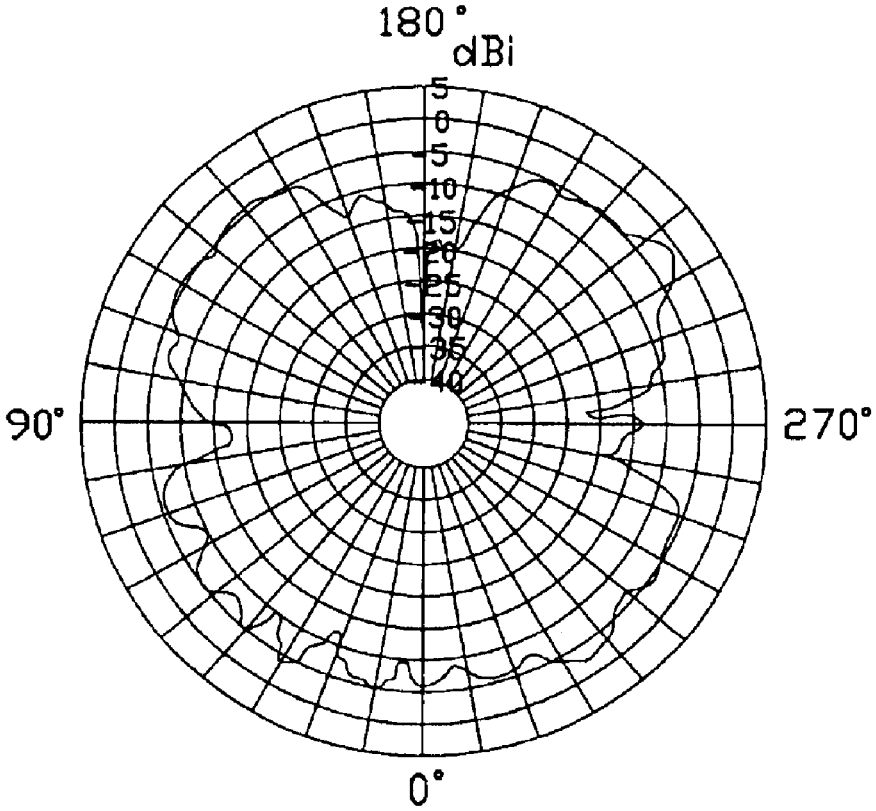
FIG. 8 is a vertically polarized principle plane radiation pattern (where the principle plane is an X-Y plane) of the multi-band antenna of FIG. 1 operating at a frequency of 5.35 GHz.
Figure 9:
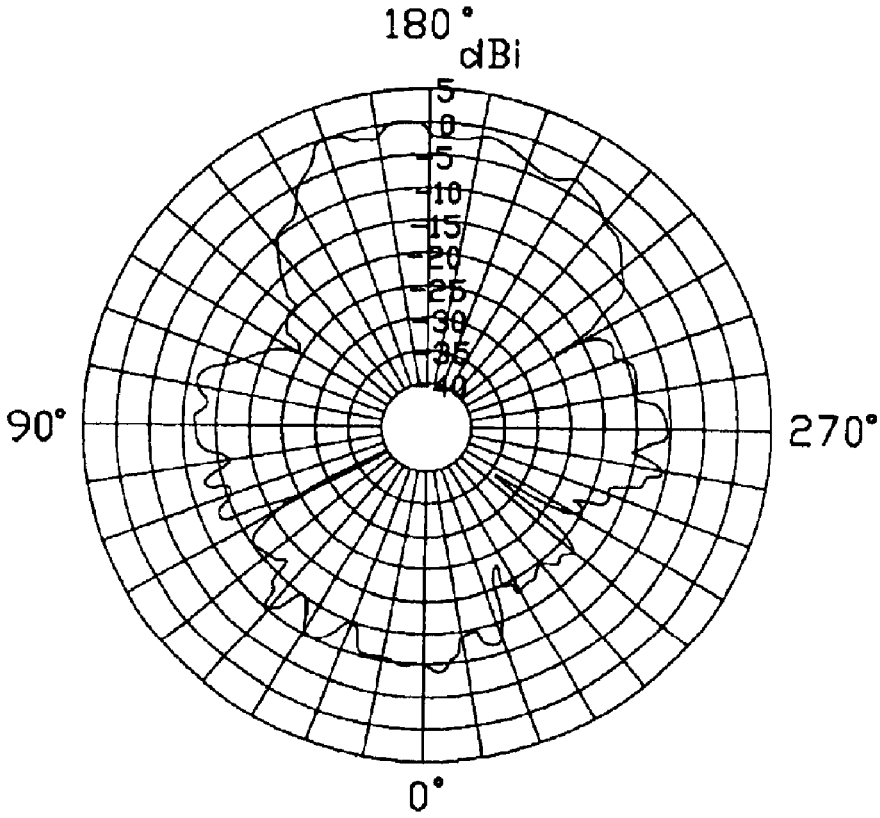
FIG. 9 is a horizontally polarized principle plane radiation pattern (where the principle plane is an X-Y plane) of the multi-band antenna of FIG. 1 operating at a frequency of 5.725 GHz.
Figure 10:
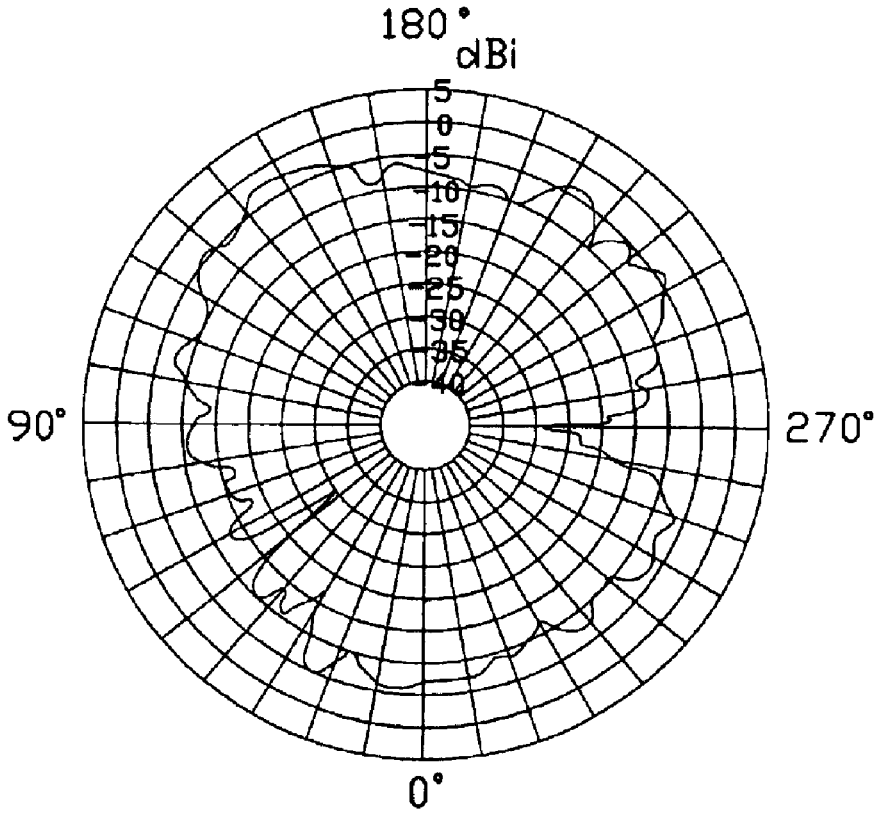
FIG. 10 is a vertically polarized principle plane radiation pattern (where the principle plane is an X-Y plane) of the multi-band antenna of FIG. 1 operating at a frequency of 5.725 GHz.

FIG. 4 shows a test chart recording of Voltage Standing Wave Ratio (VSWR) of the multi-band antenna 1 as a function of frequency. Note that VSWR drops below the desirable maximum value "2" in the 2.45 GHz frequency band and in the 5 GHz frequency band, indicating acceptably efficient operation in these two frequency bands and a wide bandwidth in the 5 GHz frequency band. Thus, the multi-band antenna 1 is capable of being used for both 802.11b standard (the 2.45 GHz frequency band) and all frequency bands of the 802.11a standard (the 5 GHz frequency band).

FIGS. 5–10 respectively show horizontally and vertically polarized principle plane radiation patterns of the multi-band antenna 1 operating at frequencies of 2.5 GHz, 5.35 GHz and 5.725 GHz (the principle plane is the X-Y plane shown in FIG. 1) after the multi-band antenna 1 is mounted in the electrical device. Note that each radiation pattern is close to a corresponding optimal radiation pattern.

Particularly referring to FIGS. 2 and 3, a medium portion 11 can be positioned between the first radiating arm 21 and the grounding portion 10. The medium portion 11 functions as a supporting means and also can help to further reducing the whole length of the multi-band antenna 1.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A multi-band antenna comprising:

a grounding portion;

a first radiating portion operating in a first frequency band, the first radiating portion being spaced from the grounding portion;

a second radiating portion operating in a second frequency band, the second radiating portion extending from the first radiating portion;

a connection portion comprising an end connecting with the grounding portion and an opposite end connecting with the first and the second radiating portions, and a feed line electrically connecting with a selected section of the connection portion, the selected section being arranged between two ends of the connection portion; wherein the first radiating portion comprising a step-like free end.

2. The multi-band antenna as claimed in claim 1, wherein the connection portion comprises a first segment, a second segment and a third segment, the first segment extending from the grounding portion, the third segment extending from a joint of the first and the second radiating portions, the second segment interconnecting the first and the third segments.

3. The multi-band antenna as claimed in claim 2, wherein the second segment is capacitively coupled to the radiating portions and the grounding portion, and has a predetermined length to approximately adjust the characteristics of the multi-band antenna.

4. The multi-band antenna as claimed in claim 2, wherein the feed line is a coaxial cable comprising an inner conductor and an outer conductor, the inner conductor electrically connecting with the selected section of the second segment of the connection portion, the outer conductor electrically connecting the grounding portion.

5. The multi-band antenna as claimed in claim 4, wherein the grounding portion defines a fixing notch for retaining the feed line.

6. The multi-band antenna as claimed in claim 5, wherein the grounding portion defines a mounting hole.

7. The multi-band antenna as claimed in claim 1, wherein the second radiating portion comprises a curved section extending towards the grounding portion, and wherein the curved section comprises a concave surface facing the grounding portion.

8. The multi-band antenna as claimed in claim 1, comprising a medium portion positioned between the grounding portion and the first radiating portion.

9. A multi-band antenna comprising:

a first radiating portion comprising a planar strip;

a second radiating portion comprising a curved strip;

a grounding portion being spaced from the first and the second radiating portions;

a connection portion interconnecting the grounding portion and the first and the second radiating portions; and a feed line electrically connecting with a substantial middle section of the connection portion;

wherein the first and the second radiating portion, the grounding portion and the connection portion are formed of a same metal foil.

10. The multi-band antenna as claimed in claim 9, wherein the connection portion comprises a first segment, a second segment and a third segment, the first segment extending from the grounding portion, the third segment extending from a joint of the first and the second radiating portions, the second segment interconnecting the first and the third segments.

11. The multi-band antenna as claimed in claim 10, wherein the second segment is capacitively coupled to the radiating portions and the grounding portion, and has a predetermined length to approximately adjust the characteristics of the multi-band antenna.

12. The multi-band antenna as claimed in claim 10, wherein the feed line is a coaxial cable comprising an inner conductor and an outer conductor, the inner conductor electrically connecting with a selected point of the substantial middle section of the second segment of the connection portion, the outer conductor electrically connecting the grounding portion.

13. The multi-band antenna as claimed in claim 9, wherein the first radiating portion, the connection portion, the grounding portion and the feed line are configured and sized to function as a first planar inverted-F antenna operating in a first frequency band.

14. The multi-band antenna as claimed in claim 13, wherein the first radiating portion comprises a step-liked free end.

15. The multi-band antenna as claimed in claim 9, wherein the second radiating portion, the connection portion, the grounding portion and the feed line are configured and sized to function as a second planar inverted-F antenna operating in a second frequency band.

16. The multi-band antenna as claimed in claim 9, comprising a medium portion position between the grounding portion and the first radiating portion.

17. A multi-band antenna comprising:

a planar grounding portion;

a Z-like connection portion integrally extending vertical from an edge of the grounding portion; and a first radiating arm and a second radiating arm both linked to an upper end of the connection portion while extending in opposite directions; wherein at least one of said first radiating arm and said second radiating arm defines a main body which is essentially spatially parallel to said grounding portion; and wherein the other of said first radiating arm and said second radiating arm extends downwardly toward the grounding portion.

18. The multi-band antenna as claimed in claim 17, wherein said one of the first radiating arm and the second radiating arm further includes other portions extending from said main body away from the other of the first radiating arm and the second radiating arm, thus commonly forming a Z-like configuration thereof.

19. The multi-band antenna as claimed in claim 17, wherein said other of the first radiating arm and the second radiating arm defines a curved configuration toward said grounding portion.

* * * * *